US010060276B2

(12) United States Patent
Tanaka

(10) Patent No.: US 10,060,276 B2
(45) Date of Patent: Aug. 28, 2018

(54) TURBINE ROTOR, TURBINE, AND METHOD FOR REMOVING SEAL PLATE

(71) Applicant: MITSUBISHI HITACHI POWER SYSTEMS, LTD., Kanagawa (JP)

(72) Inventor: Tokuhito Tanaka, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 264 days.

(21) Appl. No.: 14/764,309

(22) PCT Filed: Mar. 19, 2014

(86) PCT No.: PCT/JP2014/057579
§ 371 (c)(1),
(2) Date: Jul. 29, 2015

(87) PCT Pub. No.: WO2014/148566
PCT Pub. Date: Sep. 25, 2014

(65) Prior Publication Data

US 2015/0369062 A1 Dec. 24, 2015

(30) Foreign Application Priority Data

Mar. 22, 2013 (JP) ..... 2013-060143

(51) Int. Cl.
*F01D 5/30* (2006.01)
*F01D 11/00* (2006.01)
*F01D 5/08* (2006.01)

(52) U.S. Cl.
CPC ..... *F01D 5/3015* (2013.01); *F01D 5/081* (2013.01); *F01D 11/003* (2013.01);
(Continued)

(58) Field of Classification Search
CPC .... F01D 5/3015; F01D 11/005; F01D 11/006; F01D 11/001; F01D 11/02; F01D 5/32;
(Continued)

(56) References Cited

U.S. PATENT DOCUMENTS 3,266,770 A * 8/1966 Harlow ..... F01D 5/081 416/174
3,397,865 A * 8/1968 Shaw ..... F01D 5/3015 416/221

(Continued)

FOREIGN PATENT DOCUMENTS

CN 1043540 7/1990
CN 101836018 9/2010

(Continued)

OTHER PUBLICATIONS

First Office Action dated Feb. 29, 2016 in corresponding Chinese Application No. 201480006335.2 (with partial English Translation).

(Continued)

*Primary Examiner* — Mark Laurenzi
*Assistant Examiner* — Xiaoting Hu
(74) *Attorney, Agent, or Firm* — Wenderoth, Lind & Ponack, L.L.P.

(57) ABSTRACT

A turbine rotor includes: a rotor shaft part; a plurality of blades secured to an outer periphery of the rotor shaft part; and a seal plate configured to be fitted into a groove and configured to seal off a flow of gas in an axial direction, the groove being defined in a platform of one of the blades so as to be recessed toward an outer side in a radial direction and to extend in a peripheral direction. A blind tool hole into which a removing tool can be inserted is defined in an outside surface of the seal plate opposite an inside surface that faces a blade root of the one of the blades.

8 Claims, 13 Drawing Sheets

(52) U.S. Cl.
CPC ..... *F01D 11/006* (2013.01); *F05D 2230/68* (2013.01); *F05D 2230/70* (2013.01); *F05D 2260/30* (2013.01); *Y10T 29/49323* (2015.01)

(58) Field of Classification Search
CPC ..... F01D 5/323; F01D 5/326; F01D 5/081; F05D 2230/68; F05D 2230/70; F05D 2240/55; F05D 2240/80; F05D 2260/30; F05D 230/60–230/80; F05D 2230/60–2230/80; Y10T 29/49323; Y02T 50/676
See application file for complete search history.

(56) References Cited

U.S. PATENT DOCUMENTS 3,501,249 A * 3/1970 Scalzo ..... F01D 5/081 416/193 A
3,644,058 A * 2/1972 Barnabei ..... F01D 5/081 416/219 R
3,807,898 A * 4/1974 Guy ..... F01D 5/3015 416/218
3,853,425 A * 12/1974 Scalzo ..... F01D 5/3015 416/193 A
4,021,138 A * 5/1977 Scalzo ..... F01D 5/081 416/193 A
4,507,052 A * 3/1985 Thompson ..... F01D 5/187 415/173.7
5,201,849 A * 4/1993 Chambers ..... F01D 11/005 416/220 R
5,257,909 A 11/1993 Glynn et al.
5,967,745 A * 10/1999 Tomita ..... F01D 11/001 415/173.7
5,984,637 A * 11/1999 Matsuo ..... F01D 5/081 415/115
6,189,891 B1 * 2/2001 Tomita ..... F01D 11/001 277/414
6,220,814 B1 * 4/2001 Brushwood ..... F01D 11/001 219/201
7,264,447 B2 * 9/2007 Ono ..... F01D 11/005 416/193 A
7,371,050 B2 * 5/2008 Pasquiet ..... F01D 5/3015 416/204 A
9,181,810 B2 * 11/2015 Dimmick, III ..... F01D 5/3015
9,803,485 B2 * 10/2017 Snyder ..... F01D 5/3015
2008/0008593 A1 1/2008 Zagar et al.
2008/0181767 A1 * 7/2008 Brillert ..... F01D 5/081 415/170.1
2014/0356177 A1 * 12/2014 Snyder ..... F01D 5/3015 416/220 R

FOREIGN PATENT DOCUMENTS

| | | |
|---|---|---|
| JP | 61-205302 | 9/1986 |
| JP | 10-008906 | 1/1998 |
| JP | 11-247616 | 9/1999 |
| JP | 2005-163732 | 6/2005 |
| JP | 2012-52550 | 3/2012 |

OTHER PUBLICATIONS

International Search Report dated Apr. 22, 2014 in International Application No. PCT/JP2014/057579 (with English Translation).
Written Opinion of the International Searching Authority dated Apr. 22, 2014 in International Application No. PCT/JP2014/057579 (with English Translation).

* cited by examiner

TURBINE ROTOR, TURBINE, AND METHOD FOR REMOVING SEAL PLATE

CROSS-REFERENCE TO RELATED APPLICATION

This application claims priority based on Japanese Patent Application No. 2013-060143 filed on Mar. 22, 2013, the contents of which are incorporated herein by reference.

TECHNICAL FIELD

The present invention relates to a turbine rotor that includes a seal plate that is disposed on at least one side in an axial direction of a blade root of a blade and that seals off a flow of gas in the axial direction, a turbine including this turbine rotor, and a method for removing a seal plate.

BACKGROUND ART

The turbine rotor of a gas turbine includes a rotor shaft part that extends in an axial direction with an axial line serving as the center, and a plurality of blades aligned in a peripheral direction with respect to the axial line and secured to the rotor shaft part.

The turbine rotor further includes a seal assembly for sealing off a flow of gas in the axial direction in a space between blades adjacent in the peripheral direction, in a region on the inner side in the radial direction of a platform of the blades.

Such a seal assembly is disclosed, for example, in U.S. Pat. No. 4,021,138. This seal assembly includes a seal plate that seals off a flow of gas in the axial direction in the aforementioned space, and a bolt and washer for suppressing movement of the seal plate in the peripheral direction.

An outside groove recessed outward in the radial direction and extending in the peripheral direction is formed on an end portion in the axial direction of the platform of the blade. Further, an inside groove recessed inward in the radial direction and extending in the peripheral direction is formed on the rotor shaft part in a position facing the outside groove of the blade in the radial direction.

The end portion on the outer side in the radial direction of the seal plate is fitted into the outside groove of the platform, and the end portion on the inner side in the radial direction of the seal plate is fitted into the inside groove of the rotor shaft part.

Technical Problem

According to the technique described in U.S. Pat. No. 4,021,138, when the turbine is operated for a long period of time, the seal plate becomes affixed with dust and the like to the groove, making it extremely difficult to remove this seal plate from the groove. Further, when an attempt is made to forcibly remove this seal plate from the groove, the seal plate may be damaged.

SUMMARY OF INVENTION

Therefore, an object of the present invention is to provide a turbine rotor including a seal plate that can be easily removed from a groove, a turbine including this turbine rotor, and a method for removing a seal plate.

Solution to Problem

According to an aspect of the present invention for resolving the above-described problems, a turbine rotor includes: a rotor shaft part extending in an axial direction; a plurality of blades secured to an outer periphery of the rotor shaft part; a seal plate disposed facing a blade root of each of the blades on at least one side in the axial direction of the blade root, the seal plate being configured to be fitted into a groove and to seal off a flow of gas in the axial direction, the groove being formed in a platform of each of the blades so as to be recessed toward the outer side in the radial direction and to extend in the peripheral direction; and a locking plate disposed on the inner side in the radial direction of the seal plate, the locking plate being engaged with an end portion on the inner side in the radial direction of the seal plate with both partially overlapping each other in the radial direction. In such a turbine rotor, a blind hole is formed in the outside surface of the seal plate opposite the inside surface of the seal plate that faces the blade root and is configured to enable a removing tool to be inserted therein, the inside surface of the seal plate is flat across its entirety in the radial direction, and the outside surface of the seal plate is flat across its entirety in the radial direction, excluding the hole.

It should be noted that, in the above, the axial direction refers to the direction in which an axial line serving as the center of the rotor shaft part extends, the radial direction refers to the radial direction relative to this axial line, and the peripheral direction refers to the peripheral direction relative to this axial line.

According to the turbine rotor, the seal plate can be easily removed from the groove by inserting the removing tool into the hole formed in this seal plate and applying force toward the inner side in the radial direction, and, if necessary, applying force in the peripheral direction, to this removing tool.

As described above, when force is applied to the removing tool, it is preferable that slight force in a direction toward the blade root be also applied to the removing tool to ensure that the insertion portion of this removing tool does not disengage from the hole. Even if the force in a direction toward the blade root is thus applied to the removing tool, the insertion portion of this removing tool will not pierce through the seal plate since the hole is blind. Therefore, according to the turbine rotor, the removing tool can be easily operated.

According to the turbine rotor, the inside surface of the seal plate is flat across its entirety in the radial direction and thus, when this seal plate is removed from the groove, it does not catch on the blade root or the like that faces the inside surface of the seal plate during the movement of the seal plate toward the inner side in the radial direction. Therefore, according to the turbine rotor, the seal plate can be easily removed from the groove from this perspective as well. Additionally, according to the turbine rotor, the inside surface of the seal plate is flat across its entirety in the radial direction, preventing any extra gap from forming between the seal plate and the blade root of the blade, and making the sealing effect more readily exhibitable.

According to this turbine rotor, the outside surface of the seal plate is flat across its entirety in the radial direction, excluding the hole, making it possible to suppress manufacturing costs. In particular, if the inside surface is also flat across its entirety in the radial direction, the seal plate is flat in shape, excluding the hole portion, making it possible to further suppress manufacturing costs.

Further, in any one of the seal plates of the turbine rotor, the hole may be formed in the center portion in the peripheral direction and the radial direction.

According to the seal plate, the hole is formed in the center portion in the peripheral direction and the radial direction, thereby allowing the removing tool to easily approach the hole from every direction orthogonal to the axial direction.

Further, in any one of the seal plates of the turbine rotor, the opening shape of the hole may correspond to the cross-sectional shape of the insertion portion of the removing tool to be inserted into the hole.

According to the seal plate, the insertion portion of the removing tool and the tool hole readily fit together, improving the operability of the removing tool.

Further, in any one of the seal plates of the turbine rotor, the opening shape of the hole may be a circle.

According to the seal plate, this hole can be formed very easily using an end mill or drill with an outer diameter corresponding to the size of the opening of the hole. Thus, by making the opening shape of the hole circular, it is possible to suppress the manufacturing costs of the seal plate. Additionally, according to the seal plate, since the opening shape of the hole is a circle, force is easily applied from the removing tool to the seal plate regardless of the angle at which the removing tool is inserted, making it easy to perform the operation even if the space is narrow.

Further, in any one of the seal plates of the turbine rotor, the opening shape of the hole may be a polygon.

When the opening shape of the hole is a polygon, it becomes easy to apply force from the removing tool to the seal plate in a direction orthogonal to a side that forms the edge of the opening. In particular, if any one side that forms the edge of the polygonal opening is orthogonal to the radial direction, it becomes easy to apply force from the removing tool to the seal plate in the radial direction. Furthermore, when the opening shape of the hole is a polygon, it becomes easy to apply force from the removing tool to the seal plate using a corner of the polygon.

Further, in any one of the seal plates of the turbine rotor, the depth of the hole may gradually increase from the outer side in the radial direction toward the inner side in the radial direction on the opposite side to the outer side in the radial direction.

A bottom surface of the hole in the seal plate gradually inclines in a direction toward the blade root, from the outer side in the radial direction toward the inner side in the radial direction. As a result, according to the seal plate, it allows the removing tool to easily approach the hole from the outer side in the radial direction to the inner side in the radial direction that is the side nearer to the blade root. Further, according to the seal plate, when the removing tool is inserted into the hole and force is applied to the removing tool toward the inner side in the radial direction, the insertion end of the removing tool is positioned in the deepest position in the hole, making the insertion portion of the removing tool less likely to disengage from the hole.

Further, according to an aspect of the present invention for resolving the above-described problems, a turbine includes the turbine rotor and a casing that rotatably covers the turbine rotor.

Further, according to an aspect of the present invention for resolving the above-described problems, a method for removing a seal plate of a turbine rotor in which the turbine rotor includes: a rotor shaft part extending in an axial direction; a plurality of blades secured to the outer periphery of the rotor shaft part; a seal plate disposed facing a blade root of each of the blades on at least one side in the axial direction of the blade root, the seal plate being configured to be fitted into a groove and to seal off a flow of gas in the axial direction, the groove being formed in a platform of each of the blades so as to be recessed toward the outer side in the radial direction and to extend in the peripheral direction; and a locking plate disposed on the inner side in the radial direction of the seal plate, the locking plate being engaged with an end portion on the inner side in the radial direction of the seal plate with both partially overlapping each other in the radial direction, includes the steps of: forming a blind hole in advance that allows a removing tool to be inserted therein in a surface of the seal plate opposite another surface of the seal plate that faces the blade root; removing the locking plate; and removing the seal plate by inserting the removing tool into the hole and operating the removing tool to move the seal plate to the inner side in the radial direction and in the peripheral direction of the turbine rotor or at least to the inner side in the radial direction.

According to an aspect of the present invention for resolving the above-described problems, a seal plate of a turbine rotor is disposed facing a blade root of a blade secured to a rotor shaft part on at least one side in the axial direction of the blade root and is configured to be fitted into a groove and to seal off a flow of gas in the axial direction. The groove is formed in a platform of the blade so as to be recessed toward the outer side in the radial direction and to extend in the peripheral direction. In such a seal plate, a blind hole is formed in an outside surface opposite an inside surface that faces the blade root and is configured to allow a removing tool to be inserted therein.

Advantageous Effects of Invention

According to an aspect of the present invention, the seal plate can be easily removed from the groove by inserting the removing tool into the hole formed in this seal plate and applying force toward the inner side in the radial direction, and, if necessary, applying force in the peripheral direction, to this removing tool.

DESCRIPTION OF EMBODIMENTS

The following describes in detail an embodiment of a turbine according to the present invention, with reference to the drawings.

Figure 1:
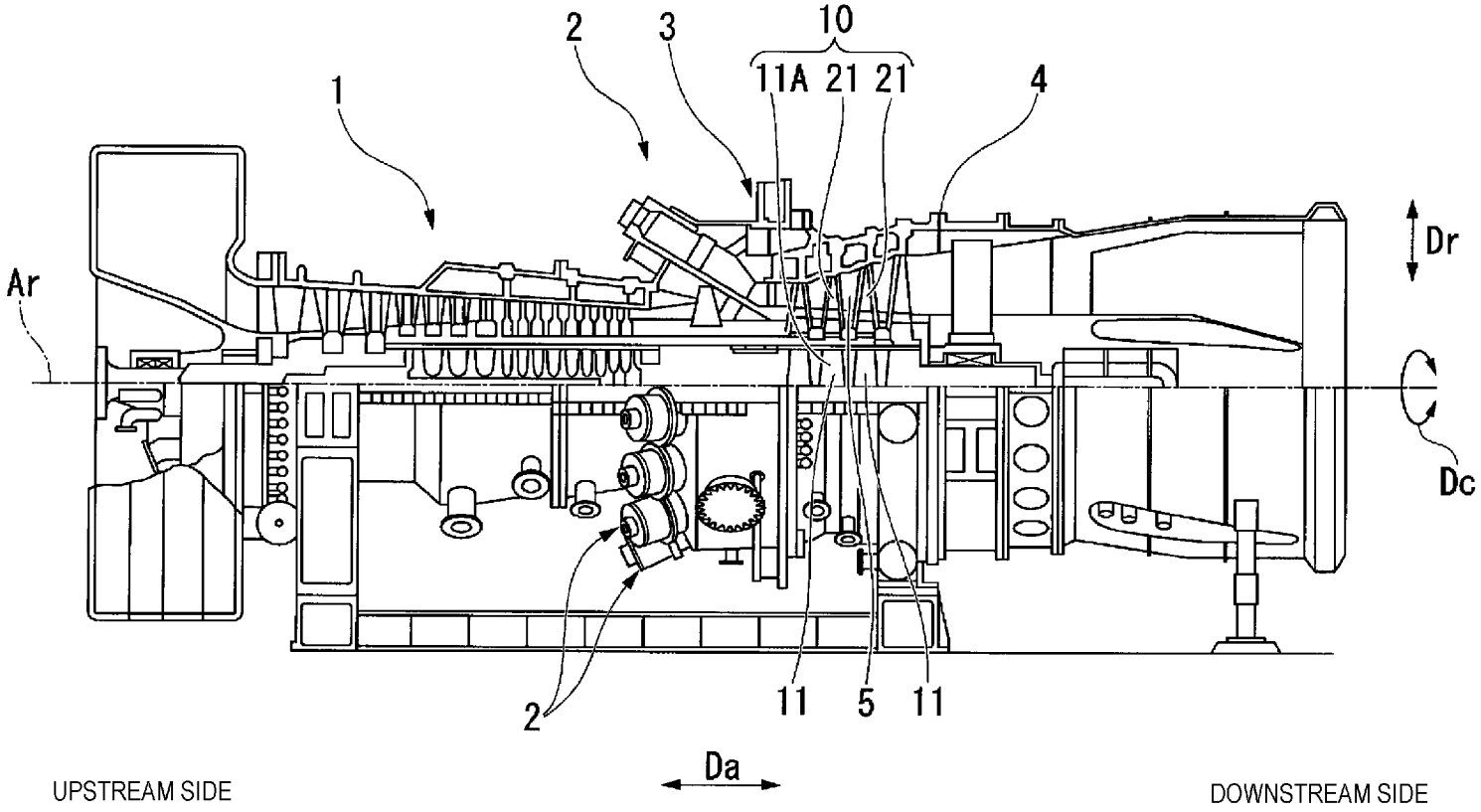
FIG. 1 is a cutaway side view illustrating the main portion of a gas turbine of an embodiment according to the present invention.

As illustrated in FIG. 1, a gas turbine includes a compressor 1 that compresses outside air to generate compressed air, a combustor 2 that mixes a fuel from a fuel supply source with the compressed air and combusts the mixture to generate a combustion gas, and a turbine 3 that is driven by the combustion gas.

The turbine 3 includes a casing 4, and a turbine rotor 10 that rotates inside this casing 4. This turbine rotor 10 is, for example, connected to a generator (not illustrated) that generates power by the rotation of this turbine rotor 10. It should be noted that, hereinafter, the direction in which an axial line Ar extends, which serves as the center of rotation of the turbine rotor 10, will be referred to as axial direction Da. Further, in a radial direction Dr with respect to the axial line Ar, the side nearer to the axial line Ar will be referred to as the inner side in the radial direction, and the side farther away from the axial line Ar will be referred to as the outer side in the radial direction. Furthermore, the upstream side and the downstream side of the flow of combustion gas in the axial direction Da will be simply referred to as the upstream side and the downstream side.

The turbine rotor 10 includes a rotor shaft part 10A that extends in the axial direction Da with the axial line Ar serving as the center, and a plurality of blades 21 aligned in a peripheral direction Dc relative to the axial line Ar and secured to the outer periphery of the rotor shaft part 10A. The rotor shaft part 10A is formed with a plurality of rotor disks 11 aligned in the axial direction Da and interconnected. The aforementioned plurality of blades 21 are secured to the outer peripheries of the respective rotor disks 11. On the inner periphery of the casing 4, a plurality of vanes 5 are aligned in the peripheral direction Dc and secured as a vane row on the respective upstream sides of the blades 21 of the rotor disks 11.

Figure 2:
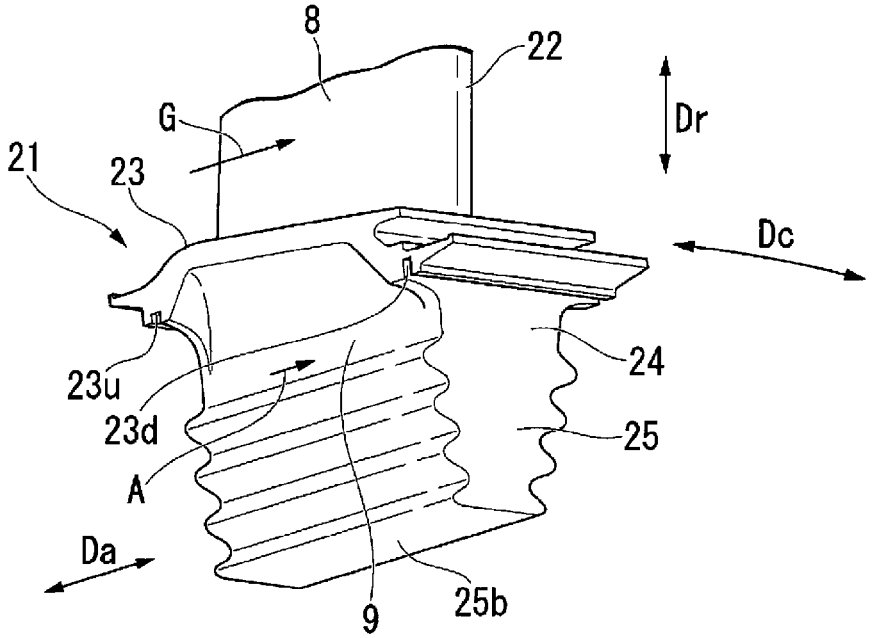
FIG. 2 is a perspective view illustrating the main portion of a blade of the embodiment according to the present invention.

The blade 21, as illustrated in FIG. 2, includes a blade body 22 that extends in the radial direction Dr, a platform 23 that is provided on the inner side in the radial direction of this blade body 22, a shank 24 that is provided on the inner side in the radial direction of the platform 23, and a blade root 25 that is provided on the inner side in the radial direction of the shank 24. A region on the outer side in the radial direction of the platform 23, that is, the region where the blade body 22 exists, forms a combustion gas flow path 8 through which a combustion gas G from the combustor 2 passes. On the other hand, in the region on the inner side in the radial direction of the platform 23 of the blade 21, the space between the blades 21 adjacent in the peripheral direction Dc forms a cooling air space 9 into which cooling air A flows.

Outside grooves 23*u*, 23*d* that are recessed from the inner side in the radial direction toward the outer side in the radial direction and extend in the peripheral direction Dc are formed on an upstream end portion and downstream end portion of the platform 23, respectively. Further, the cross-sectional shape of the blade root 25 that is orthogonal to a blade chord direction in which the blade chord extends so as to connect the upstream end and the downstream end of the blade body 22 forms a Christmas-tree shape wherein a widened part and a narrowed part are alternately repeated toward the inner side in the radial direction.

Figure 3:
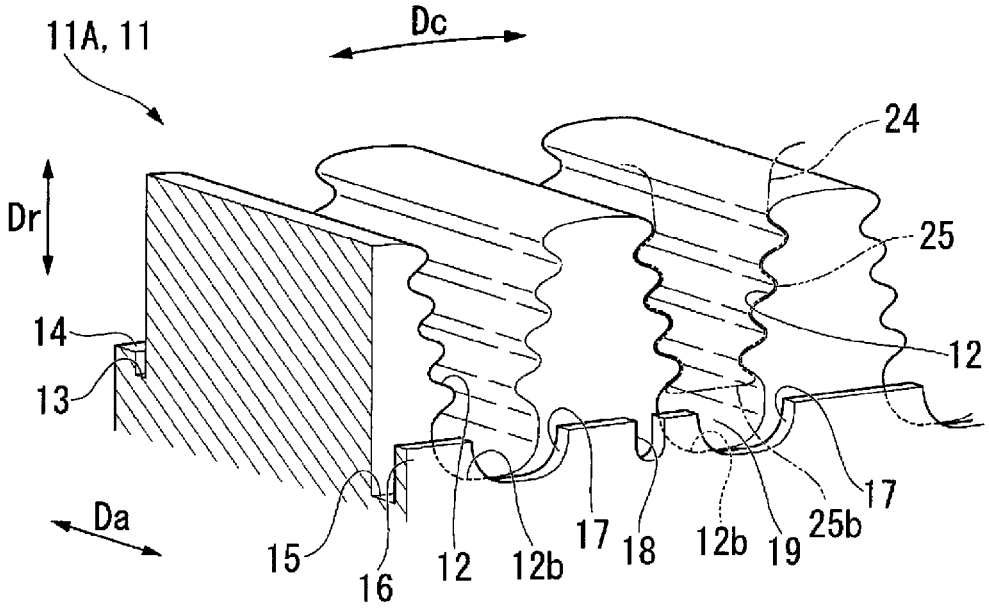
FIG. 3 is a perspective view illustrating the main portion of a rotor disk of the embodiment according to the present invention.

A blade root groove 12 into which the blade root 25 of the blade 21 is fitted is formed on the rotor disk 11, as illustrated in FIG. 3. This blade root groove 12 passes through the rotor disk 11 in the axial direction Da, forming a cross-sectional shape that corresponds to the cross-sectional Christmas-tree shape of the blade root 25. Accordingly, this blade root groove 12 forms a shape in which a widened space that has the widened part of the blade root 25 fitted therein and a narrowed space that has the narrowed part of the blade root 25 fitted therein are alternately repeated toward the inner side in the radial direction. It should be noted that, in this embodiment, of the plurality of widened spaces of the blade root groove 12, the widened space positioned on the innermost side in the radial direction is formed significantly larger than the size of the plurality of widened parts of the blade root 25. As a result, according to this embodiment, when the blade root 25 of the blade 21 is fitted into the blade root groove 12 of the rotor disk 11, there is a gap in the radial direction between a surface on the innermost side in the radial direction of the blade root 25, that is, a bottom surface 25*b* of the blade root 25, and a surface on the inner side in the radial direction of the widened space that is positioned on the innermost side in the radial direction of the blade root groove 12, that is, a groove bottom surface 12*b* of the blade root groove 12. According to this embodiment, the gap between the groove bottom surface 12*b* of the blade root groove 12 and the bottom surface 25*b* of the blade root 25 forms an in-groove cooling air path 19. This in-groove cooling air path 19 passes through the rotor disk 11 in the axial direction Da.

Inside grooves 13, 15 recessed from the outer side in the radial direction to the inner side in the radial direction and extending in the peripheral direction Dc are formed on the upstream side and the downstream side of this blade root groove 12, respectively. The inside groove 13 on the upstream side faces the outside groove 23*u* on the upstream side of the platform 23 in the radial direction Dr. Further, the inside groove 15 on the downstream side faces the outside groove 23*d* on the downstream side of the platform 23 in the radial direction Dr. Of the pair of surfaces of the inside groove 13 on the upstream side that face each other in the axial direction Da, an upstream-side surface is formed by an upstream-side barrier 14. Further, of the pair of surfaces of the inside groove 15 on the downstream side that face each other in the axial direction Da, a surface on the downstream side is formed by a downstream barrier 16.

A plurality of screw operation openings 17 are formed in the downstream barrier 16. The plurality of screw operation openings 17 that penetrate in the axial direction Da are made by cutting out the downstream barrier 16 from the outer side in the radial direction toward the inner side in the radial direction. Each of the plurality of screw operation openings 17 is formed in a position facing the blade root groove 12 in the axial direction Da, in other words, in the same position as the blade root groove 12 in the peripheral direction Dc.

Figure 4:
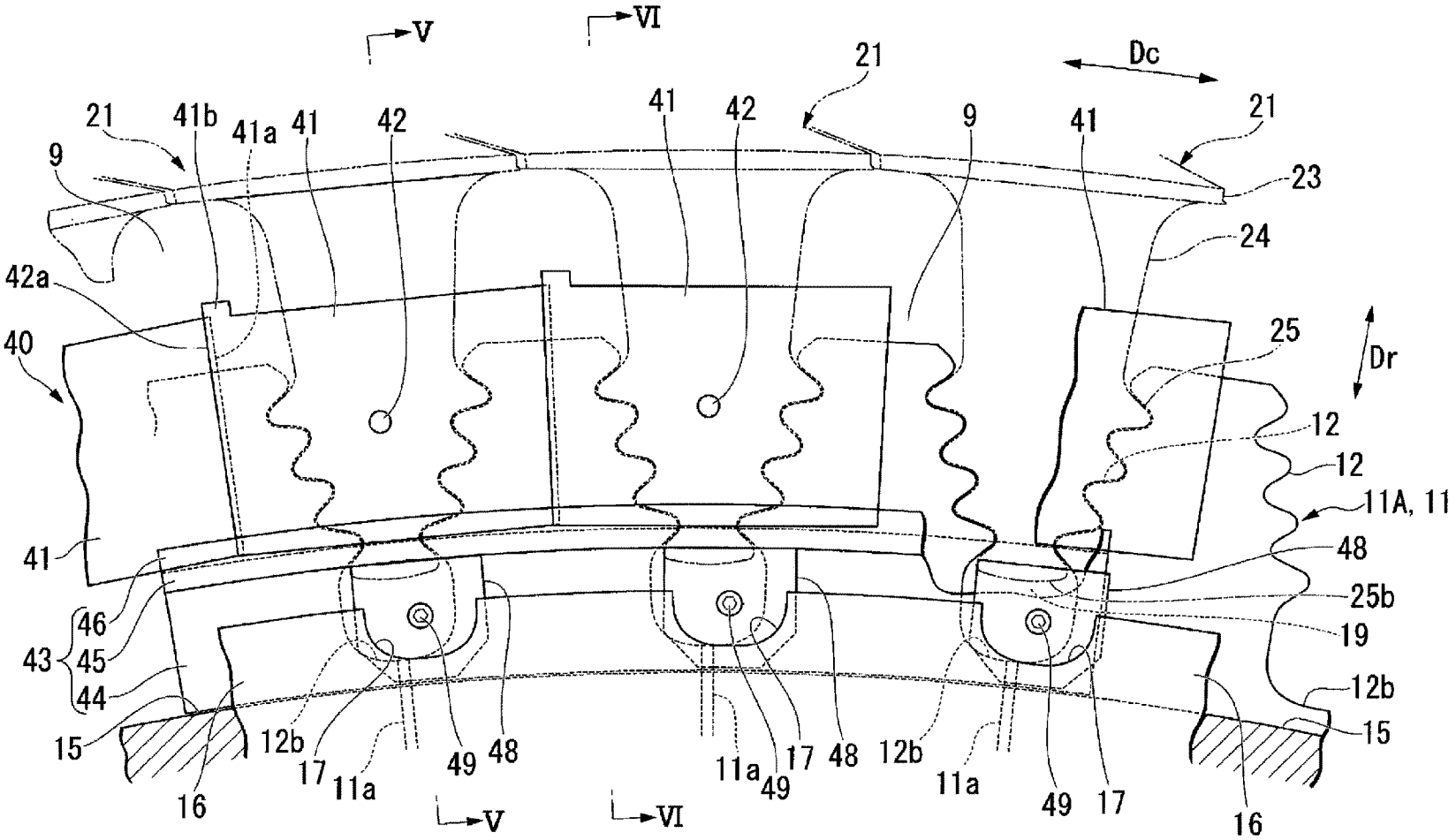
FIG. 4 is a view illustrating a portion on the outer side in the radial direction of the rotor disk of the embodiment according to the present invention, as viewed from the downstream side.
Figure 5:
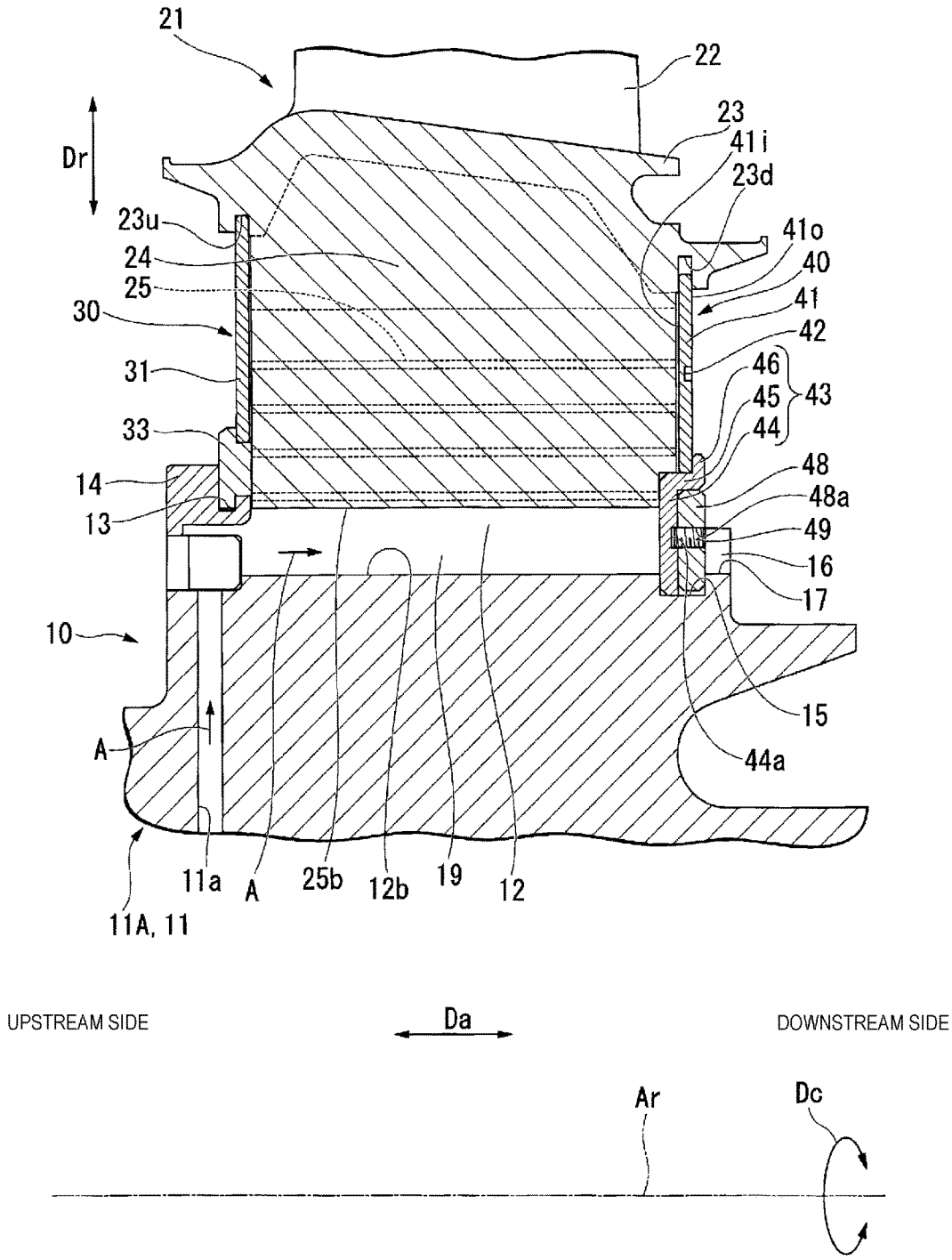
FIG. 5 is a cross-sectional view taken along a line V-V of FIG. 4.
Figure 6:
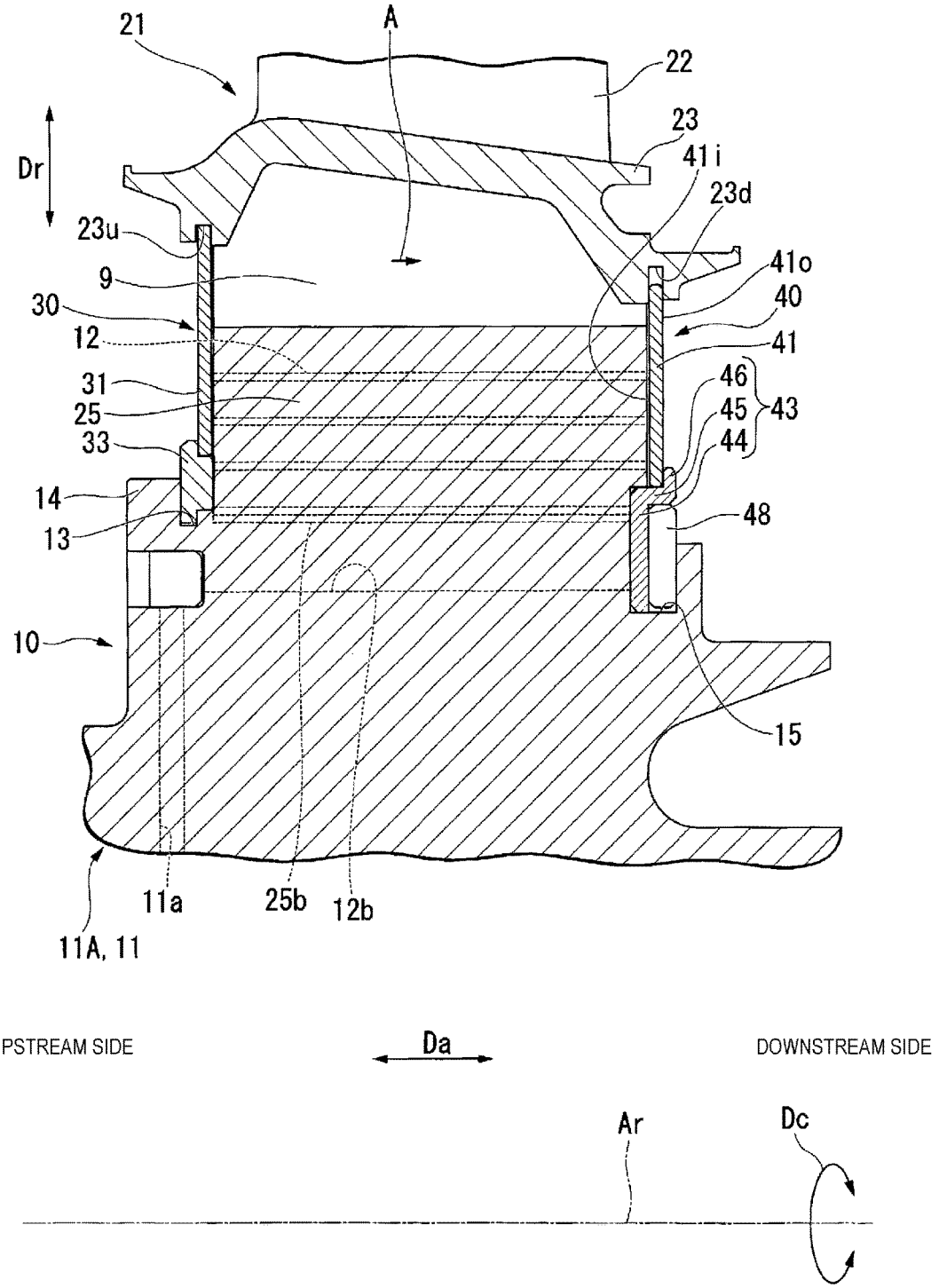
FIG. 6 is a cross-sectional view taken along a line VI-VI of FIG. 4.

As illustrated in FIGS. 4 to 6, a radial cooling air path 11*a* that extends from the inner side in the radial direction to the outer side in the radial direction and opens at the groove bottom surface 12*b* of the blade root groove 12 is formed in the rotor disk 11. It should be noted that FIG. 4 is a view illustrating a portion on the outer side in the radial direction of the rotor disk 11, as viewed from the downstream side, FIG. 5 is a cross-sectional view taken along a line V-V of FIG. 4, and FIG. 6 is cross-sectional view taken along a line VI-VI of FIG. 4. The cooling air A (FIG. 5) that passes through the radial cooling air path 11*a* flows inside the in-groove cooling air path 19, where a portion of the cooling air A passes through the cooling air path (not illustrated) formed in the blade root 25 of the blade 21 to cool the blade 21, and the other portion flows into the aforementioned cooling air space 9 (FIG. 2, FIG. 6).

The turbine rotor 10 further includes an upstream-side seal assembly 30 that seals off the aforementioned cooling air space 9 at the position of an upstream end portion of the platform 23 of the blade 21, and a downstream-side seal assembly 40 that seals off the cooling air space 9 at the position of a downstream end portion of the platform 23 of the blade 21.

The upstream-side seal assembly 30 includes an upstream-side seal plate 31 disposed facing the upstream side of the blade root 25, and an upstream-side locking plate 33 disposed on the inner side in the radial direction of this upstream-side seal plate 31. The upstream-side seal plate 31 and the upstream-side locking plate 33 each form a plate shape, and the thickness direction thereof is the same as the axial direction Da. The end portion on the outer side in the radial direction of the upstream-side seal plate 31 is fitted into the outside groove 23*u* on the upstream side of the platform 23. Further, the end portion on the inner side in the radial direction of the upstream-side locking plate 33 is fitted into the inside groove 13 on the upstream side of the rotor disk 11. The end portion on the inner side in the radial direction of the upstream-side seal plate 31 and the end portion on the outer side in the radial direction of the upstream-side locking plate 33 are engaged with both overlapping each other in the radial direction.

The downstream-side seal assembly 40, as illustrated in FIGS. 4 to 7, includes a downstream-side seal plate 41 disposed facing the downstream side of the blade root 25, a downstream-side locking plate 43 disposed on the inner side in the radial direction of this downstream-side seal plate 41, and a receiving plate 48 and a push screw 49 for pressing this downstream-side locking plate 43 toward the upstream side.

The downstream-side seal plate 41 and the downstream-side locking plate 43 each form a plate shape, and the thickness direction thereof is the same as the axial direction Da. The end portion on the outer side in the radial direction of the downstream-side seal plate 41 is fitted into the outside groove 23*d* on the downstream side of the platform 23. Further, the end portion on the inner side in the radial direction of the downstream-side locking plate 43 is fitted into the inside groove 15 on the downstream side of the rotor disk 11. The downstream-side seal plate 41 closes the downstream end portion of the cooling air space 9 in the axial direction Da, and the downstream-side locking plate 43 closes the downstream-side end portion of the in-groove cooling air path 19 in the axial direction Da. The end portion on the inner side in the radial direction of the downstream-side seal plate 41 and the end portion on the outer side in the radial direction of the downstream-side locking plate 43 are engaged with both overlapping each other in the radial direction Dr.

Figure 8A:
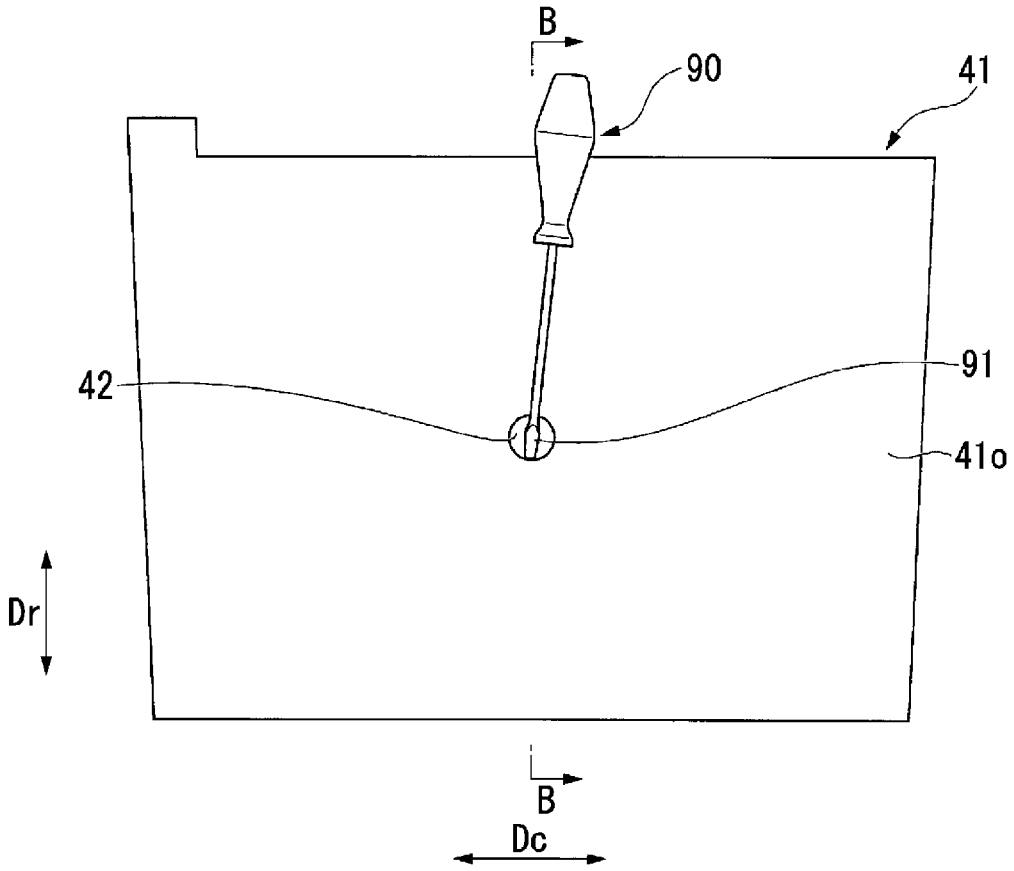
FIG. 8A is a plan view illustrating a downstream-side seal plate of the embodiment according to the present invention.
Figure 8B:
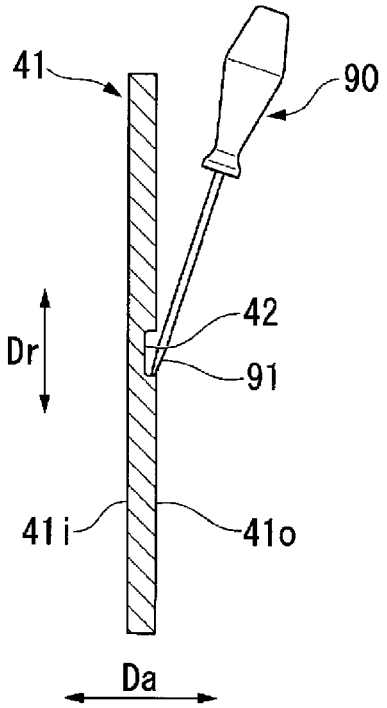
FIG. 8B is a cross-sectional view taken along a line B-B of FIG. 8A.

A blind tool hole 42 recessed toward the blade root side, that is, the upstream side, is formed in an outside surface 41*o* of the downstream-side seal plate 41, the outside surface 41*o* being on the side opposite an inside surface 41*i* that faces the blade root 25. This outside surface 41*o* is flat across its entirety in the radial direction Dr, excluding this tool hole 42. Further, the inside surface 41*i* on the side opposite the outside surface 41*o* is flat across its entirety in the radial direction Dr. The tool hole 42, as illustrated in FIG. 8A and FIG. 8B, is formed in the center portion in the radial direction Dr and the peripheral direction Dc of the downstream-side seal plate 41. This tool hole 42 forms a cylinder shape with an axis directed in the axial direction Da serving as the center, and is formed by a drill, end mill, or the like, for example. The inner diameter of the circular opening of this tool hole 42 is set to a dimension that permits an insertion portion 91 of a removing tool 90 to be inserted into the tool hole 42. The removing tool 90 is, for example, a flathead screwdriver, a Phillips screwdriver, or the like.

The downstream-side locking plate 43, as illustrated in FIGS. 4 to 7, includes a plate main body part 44 that forms a flat-plate shape, extends in the peripheral direction Dc, and is inserted into the inside groove 15 on the downstream side of the rotor disk 11, a rising part 45 that extends from the end portion on the outer side in the radial direction of the plate main body part 44 to the downstream side, and a lap part 46 that extends from the downstream end portion of the rising part 45 to the outer side in the radial direction. That is, the cross-sectional shape of this downstream-side locking plate 43 forms a crank shape. A screw abutting part 44*a* (FIG. 5) where the distal edge of the push screw 49 abuts is formed on the outside surface facing the downstream side of the plate main body part 44 of this downstream-side locking plate 43. The end portion on the inner side in the radial direction of the downstream-side seal plate 41 is positioned on the outer side in the radial direction of the rising part 45 of the downstream-side locking plate 43 and on the upstream side of the lap part 46, overlapping this lap part 46 in the radial direction Dr.

The receiving plate 48 forms a plate shape, and is inserted into the inside groove 15 on the downstream side of the rotor disk 11 along with the plate main body part 44 of the downstream-side locking plate 43, with the thickness direction of the receiving plate 48 being the same as the axial direction Da. At this time, the receiving plate 48 is positioned between the downstream barrier 16 and the plate main body part 44 of the downstream-side locking plate 43 in the axial direction Da, in the same position as the screw operation opening 17 of the downstream barrier 16 in the peripheral direction Dc. The dimensions of the receiving plate 48 in the peripheral direction Dc and the radial direction Dr are both larger than the dimensions of the screw operation opening 17 in the peripheral direction Dc and the radial direction Dr, respectively. A female screw hole 48*a* that penetrates in the axial direction Da and permits the screwing of the push screw 49 is formed in this receiving plate 48.

When the downstream-side locking plate 43 and the receiving plate 48 are disposed in the inside groove 15 on the downstream side, the receiving plate 48 and the plate main body part 44 of the downstream-side locking plate 43 are inserted into the inside groove 15 on the downstream side, and the push screw 49 is screwed into the receiving plate 48.

The plurality of downstream-side seal plates 41, as illustrated in FIG. 4, are disposed in a ring shape around the axial line Ar, and each end portion 41*a* in the peripheral direction of the downstream-side seal plates 41 forms an overlapping structure in which the end portion 41*a* in the peripheral direction overlaps the end portion 41*a* in the peripheral direction of another downstream-side seal plate 41 adjacent in the peripheral direction Dc. With this arrangement, the cooling air inside the cooling air space 9 is prevented from leaking from the area between the end portions 41*a* in the peripheral direction of the downstream-side seal plates 41 adjacent in the peripheral direction Dc into the combustion gas.

Further, a protrusion portion 41*b* that projects toward the outer side in the radial direction is provided on the end portion on the outer side in the radial direction of the downstream-side seal plate 41. The end portion on the outer side in the radial direction of the downstream-side seal plate 41 including the protrusion portion 41*b* is fitted into the outside groove 23*d*. At this time, the protrusion portion 41*b* of the downstream-side seal plate 41 abuts against a step (not illustrated) provided in the outside groove 23*d*, thereby regulating the movement of this downstream-side seal plate 41 in the peripheral direction Dc.

Next, a procedure for disassembling the downstream-side seal assembly 40 (a procedure for removing the downstream-side seal plate 41) having been described above will be described. This downstream-side seal assembly 40 is disassembled during inspection of the turbine 3, for example.

First, the push screw 49 that has been screwed into the receiving plate 48 is turned and removed from the receiving plate 48. Next, the receiving plate 48 from which the push screw 49 has been removed is moved toward the outer side in the radial direction and removed from the inside groove 15 on the downstream side. As a result, the downstream-side locking plate 43 in which the plate main body part 44 has been inserted in the inside groove 15 becomes movable in the axial direction Da as well as the peripheral direction Dc in the inside groove 15.

Hence, this downstream-side locking plate 43 is moved to the downstream side in the axial direction Da as well as in the peripheral direction Dc, and removed from the inside groove 15 on the downstream side. When the downstream-side locking plate 43 is thus removed, the downstream-side seal plate 41 becomes movable basically to the inner side in the radial direction.

However, when the turbine 3 is operated for a long period of time, foreign matter and the like enter the slight gap between the end portion on the outer side in the radial direction of the downstream-side seal plate 41 and the outside groove 23*d* on the downstream side, causing this downstream-side seal plate to be affixed or nearly affixed to the outside groove 23*d*. Consequently, even if the downstream-side locking plate 43 is removed as described above, making the downstream-side seal plate 41 movable to the inner side in the radial direction, it is basically difficult to easily remove this downstream-side seal plate 41 from the outside groove 23*d*.

Figure 7:
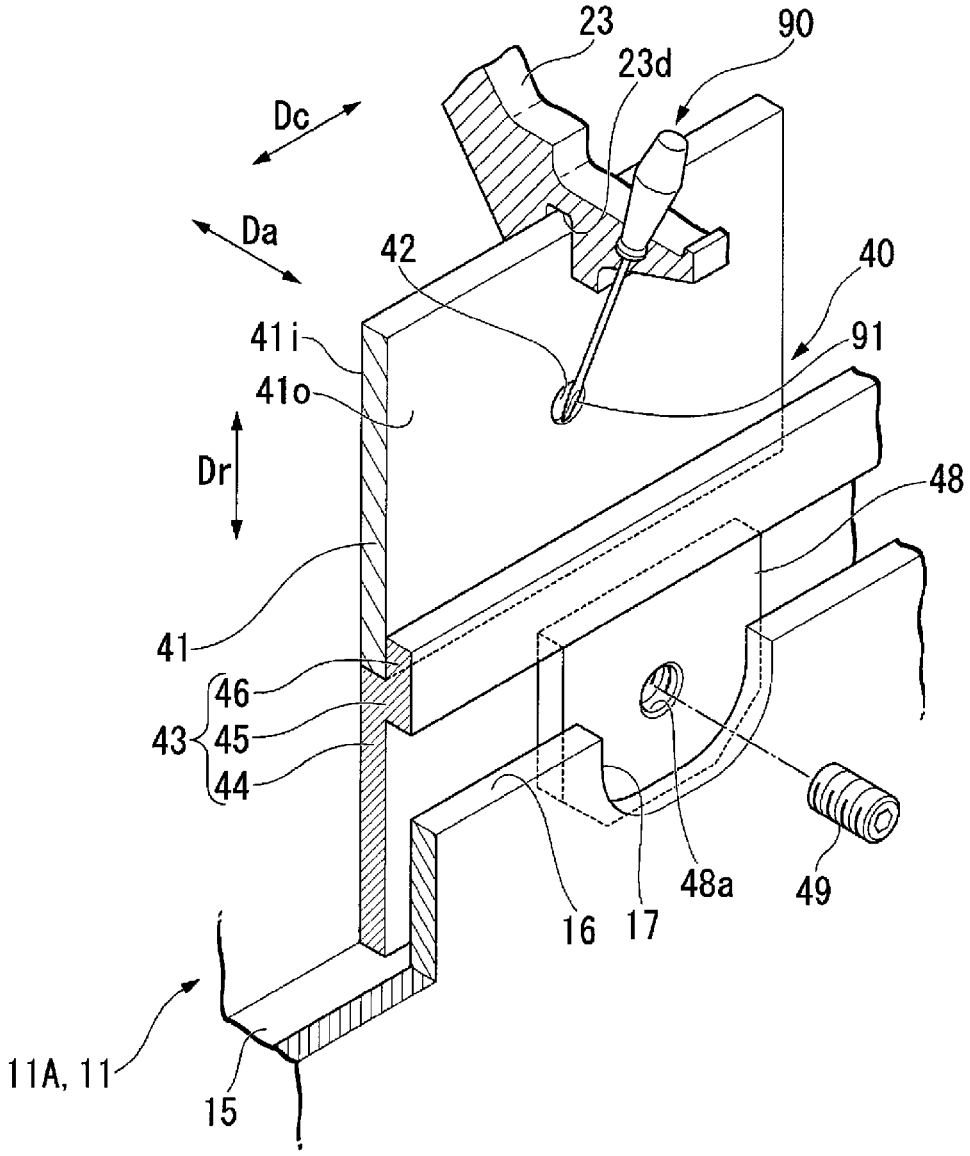
FIG. 7 is a perspective view illustrating a downstream-side seal assembly of the embodiment according to the present invention.

Nevertheless, according to this embodiment, this downstream-side seal plate 41 can be easily removed from the outside groove 23*d* by using the removing tool 90, as illustrated in FIG. 7, FIG. 8A, and FIG. 8B. Specifically, this downstream-side seal plate 41 can be easily removed from the outside groove 23*d* by inserting the insertion portion 91 of the removing tool 90, such as a flathead screwdriver, a Phillips screwdriver, or the like, into the tool hole 42 formed in the downstream-side seal plate 41 and applying force toward the inner side in the radial direction, and, as necessary, force in the peripheral direction Dc, to this removing tool 90.

When force is applied to the removing tool 90, it is preferable that slight force in a direction toward the blade root 25, that is, force in a direction toward the upstream side be also applied to the removing tool 90 to ensure that the insertion portion 91 of this removing tool 90 does not disengage from the tool hole 42. Even if force toward the upstream side is thus applied to the removing tool 90, the insertion portion 91 of this removing tool 90 does not pierce through the downstream-side seal plate 41 since the tool hole 42 of this embodiment is blind. As a result, according to this embodiment, it is possible to easily operate the removing tool 90.

Further, according to this embodiment, the inside surface 41*i* of the downstream-side seal plate 41 is flat across its entirety in the radial direction Dr and thus, when this downstream-side seal plate 41 is removed from the outside groove 23*d*, it does not catch on the blade root 25 or the like on the inside surface 41*i* side of the downstream-side seal plate 41, in other words, on the upstream side during the movement of the downstream-side seal plate 41 to the inner side in the radial direction. Thus, according to this embodiment, the downstream-side seal plate 41 can be easily removed from the outside groove 23*d* from this perspective as well. Furthermore, according to this embodiment, an extra gap is not formed between the downstream-side seal plate 41 and the blade root 25 of the blade 21, making the sealing effect more readily exhibitable.

Further, according to this embodiment, the outside surface 41*o* of the downstream-side seal plate 41 is also flat across its entirety in the radial direction Dr, excluding this tool hole 42. Thus, the downstream-side seal plate 41 of this embodiment has a flat plate shape, excluding the portion of the tool hole 42, making it possible to suppress manufacturing costs. Furthermore, since the hole shape of the tool hole 42 of this embodiment is cylindrical, this tool hole 42 can be very easily formed using an end mill or drill having an outer diameter corresponding to the size of the opening of this tool hole 42. Thus, according to this embodiment, manufacturing costs can be suppressed from this perspective as well.

It should be noted that, in this embodiment, the upstream-side seal plate 31 is removed after the blade 21 is moved to the downstream side with respect to the rotor disk 11 and removed from the rotor disk 11. For this reason, a tool hole similar to that of the downstream-side seal plate 41 does not need to be formed in the upstream-side seal plate 31.

First Modification of Seal Plate

Figure 9:
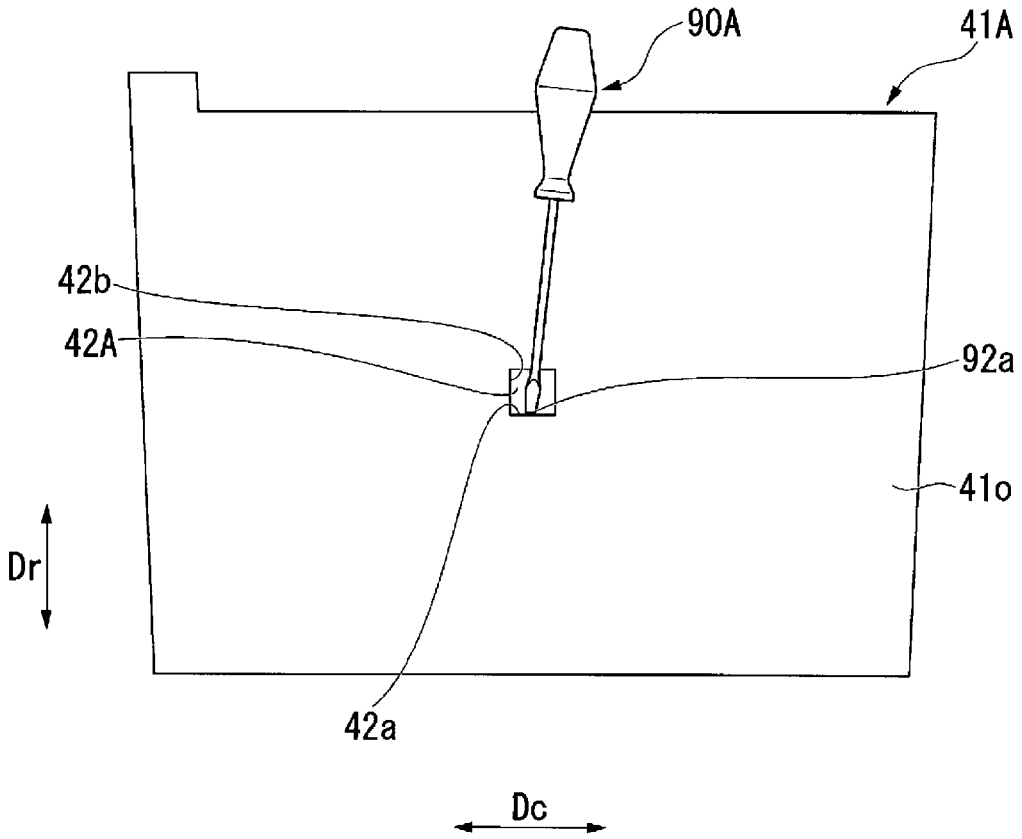
FIG. 9 is a plan view illustrating the downstream-side seal plate of a first modification according to the present invention.

Next, the first modification of the downstream-side seal plate will be described with reference to FIG. 9. It should be noted that, in the first modification and the following second and third modifications as well, only the shape of the tool hole in the downstream-side seal plate differs; all other arrangements are the same as in the above embodiment. Thus, in the first to third modifications, the shape of the tool hole is mainly described.

The shape of a tool hole 42A in a downstream-side seal plate 41A of this modification is a regular quadrangular prism. Thus, the opening shape of the tool hole 42A is a square. This tool hole 42A is, for example, formed using an end mill or drill having an outer diameter that is far smaller than the size of the opening of the tool hole 42A. Of the inner peripheral surfaces of this tool hole 42A, a pair of surfaces 42*a* that face each other, in other words, a pair of sides that form a square-shaped opening edge and face each other, are orthogonal to the radial direction Dr and stretch in the peripheral direction Dc. Accordingly, of the inner peripheral surfaces of the tool hole 42A, the other pair of surfaces 42*b* that face each other are orthogonal to the peripheral direction Dc and stretch in the radial direction Dr.

As described above, the inner peripheral surfaces of the tool hole 42A of this modification are formed by the surfaces 42*a* that are orthogonal to the radial direction Dr and stretch in the peripheral direction Dc, and the surfaces 42*b* that are orthogonal to the peripheral direction Dc and stretch in the radial direction Dr. As a result, according to this modification, when the downstream-side seal plate 41A in which this tool hole 42A is formed is moved to the inner side in the radial direction and in the peripheral direction Dc using a removing tool 90A, which is a flathead screwdriver, a contact area between the inner peripheral surfaces 42*a*, 42*b* of the tool hole 42A and an insertion end 92*a* of this removing tool 90A increases. Thus, according to this modification, when the downstream-side seal plate 41A is moved to the inner side in the radial direction and in the peripheral direction Dc, the force toward the inner side in the radial direction and in the peripheral direction Dc is readily transmitted from the removing tool 90A, which is a flathead screwdriver, to the tool hole 42A. Furthermore, force is readily applied from the removing tool to the seal plate by using a corner of the tool hole 42A.

It should be noted that while the shape of the tool hole 42A is a regular quadrangular prism in this modification, the shape may be a polygonal prism, such as a rectangular parallelepiped. That is, the opening shape of the tool hole may be a rectangle, trapezoid, parallelogram, pentagon, hexagon, or the like, rather than a square. In addition, while the above has described an example in which the removing tool 90A is a flathead screwdriver, the removing tool does not need to be a flathead screwdriver in this modification as long as the removing tool can catch onto the tool hole 42A.

Second Modification of Seal Plate

Figure 10:
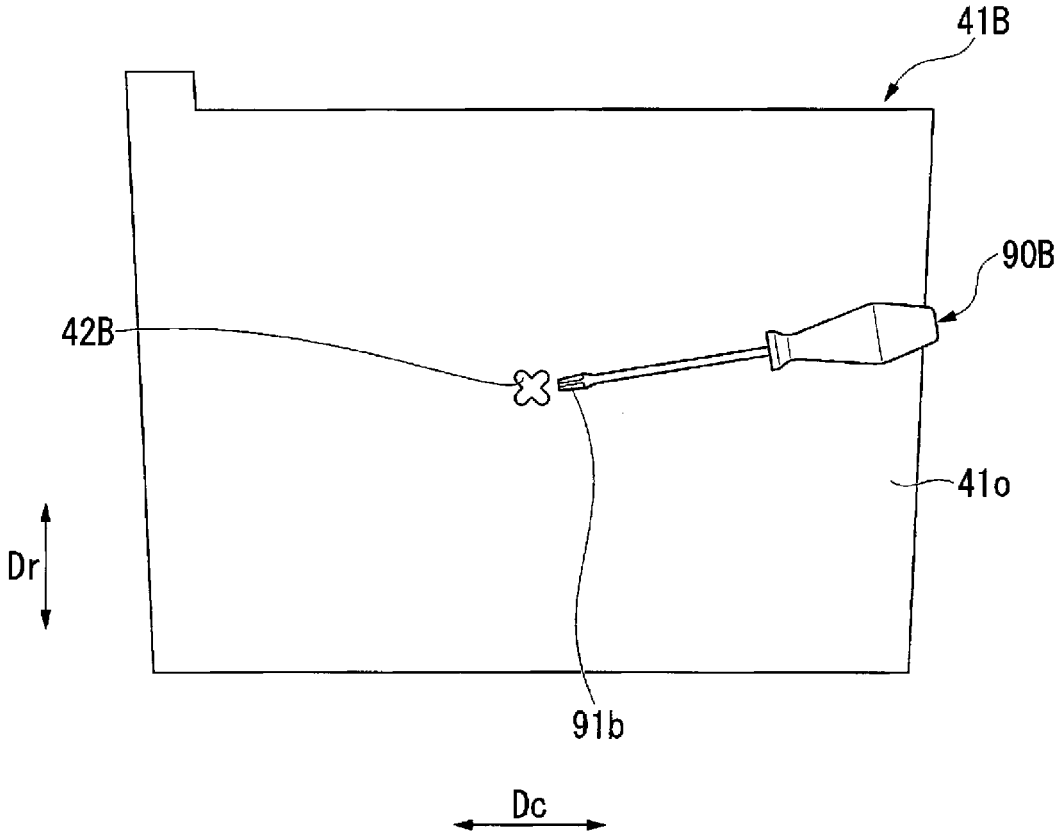
FIG. 10 is a plan view illustrating the downstream-side seal plate of a second modification according to the present invention.

Next, the second modification of the downstream-side seal plate will be described with reference to FIG. 10.

The opening shape of a tool hole 42B in a downstream-side seal plate 41B of this modification is a cross. Thus, if a Phillips screwdriver is adopted as a removing tool 90B, the opening shape of this tool hole 42B corresponds to the cross-sectional shape of an insertion portion 91*b* of this removing tool 90B.

Thus, according to this modification, if the removing tool 90B that is a Phillips screwdriver is used, the insertion portion 91*b* of this removing tool 90B and the tool hole 42B readily fit together, thereby improving the operability of the removing tool 90B. It should be noted that, in the first modification of the seal plate, if the opening shape of the tool hole is a rectangle and a removing tool that is a flathead screwdriver is used, this opening shape corresponds to the cross-sectional shape of the insertion portion of this removing tool.

Third Modification of Seal Plate

Next, the third modification of the downstream-side seal plate will be described with reference to FIG. 11A and FIG. 11B.

An axis Ah of a tool hole 42C in a downstream-side seal plate 41C of this modification is gradually inclined toward the outer side in the radial direction, from the outside surface 41*o* toward the inside surface 41*i* of this downstream-side seal plate 41C. In other words, the depth of the tool hole 42C gradually increases from the outer side in the radial direction to the inner side in the radial direction. As a result, according to this modification, a bottom surface 42*c* of the tool hole 42C is inclined so as to gradually become closer to the inside surface 41*i* of the downstream-side seal plate 41C, from the outer side in the radial direction toward the inner side in the radial direction.

Thus, according to this modification, the removing tool 90 is allowed to easily approach the tool hole 42C from the outer side in the radial direction to the inner side in the radial direction that is on the upstream side, in other words, to the side nearer to the blade. Further, when the insertion portion 91 of the removing tool 90 is inserted into the tool hole 42C and force toward the inner side in the radial direction is applied to the removing tool 90, an insertion end 92 of the removing tool 90 is positioned in the deepest position in the tool hole 42C, making the insertion portion 91 of the removing tool 90 less likely to disengage from the tool hole 42C.

Figure 11A:
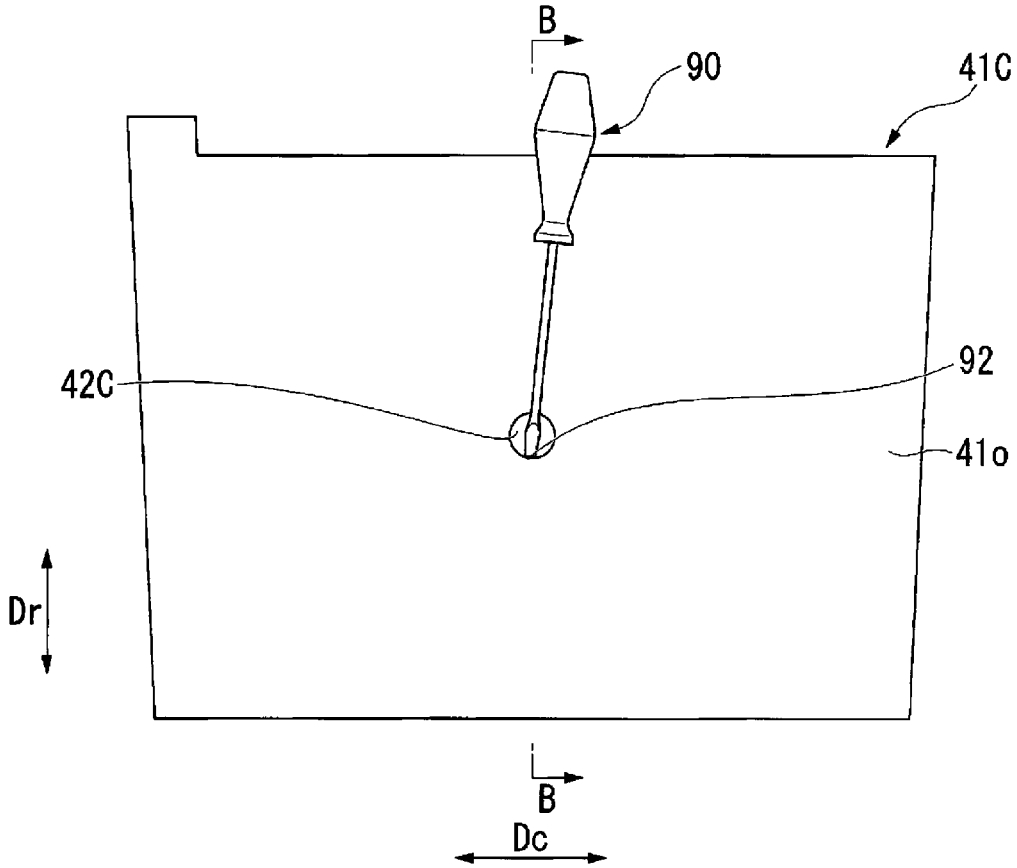
FIG. 11A is a plan view illustrating the downstream-side seal plate of a third modification according to the present invention.
Figure 11B:
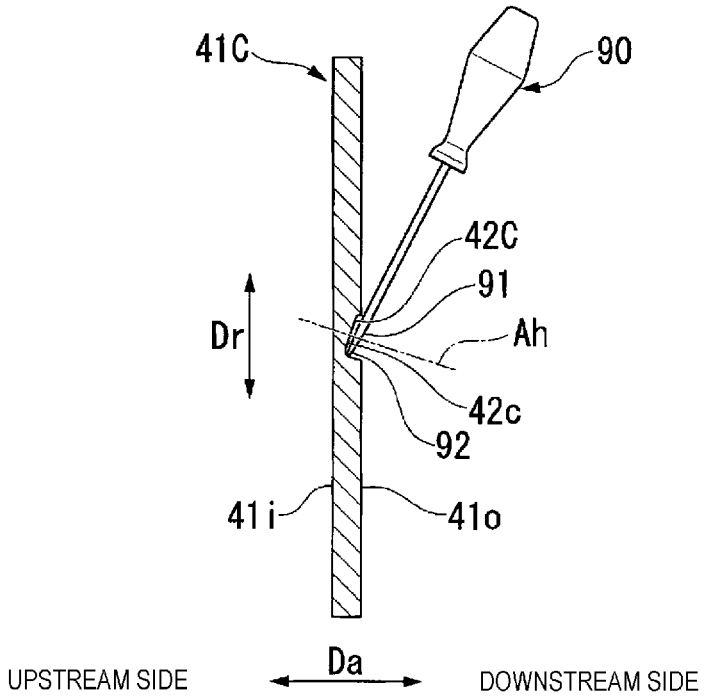
FIG. 11B is a cross-sectional view taken along a line B-B of FIG. 11A.

It should be noted that while the opening shape of this tool hole 42C is a circle in FIG. 11A and FIG. 11B, this modification is not limited to this shape, and the opening shapes of the tool hole may be a square as in the first modification, a cross as in the second modification, or the like.

Other Modifications

While the tool hole is formed in the downstream-side seal plate in the above embodiment and modifications, a similar tool hole may be formed in the upstream-side seal plate.

Further, the seal assembly of the above embodiment includes the seal plate 41, the locking plate 43, the receiving plate 48, and the push screw 49. Nevertheless, a tool hole may be formed in the same manner as in the above embodiment and modifications in a seal plate of a seal assembly of another configuration that does not include a locking plate, a receiving plate, or the like, as long as it includes a seal plate.

INDUSTRIAL APPLICABILITY

According to an aspect of the present invention, it is possible to easily remove a seal plate of a turbine rotor from a groove.

REFERENCE SIGNS LIST

1 Compressor
2 Combustor
3 Turbine
4 Casing
5 Vane
9 Cooling air space
10 Turbine rotor
11 Rotor disk
11A Rotor shaft part
12 Blade root groove
13, 15 Inside groove
14 Upstream barrier
16 Downstream barrier
17 Screw operation opening
21 Blade
22 Blade body
23 Platform
23*u*, 23*d* Outside groove (or simply groove)
25 Blade root
30 Upstream-side seal assembly
31 Upstream-side seal plate
33 Upstream-side locking plate
40 Downstream-side seal assembly
41, 41A, 41B, 41C Downstream-side seal plate (or simply seal plate)
41*o* Outside surface
41*i* Inside surface
42, 42A, 42B, 42C Tool hole
43 Downstream-side locking plate
48 Receiving plate
49 Push screw

The invention claimed is:

1. A method for removing a seal plate of a turbine rotor, the turbine rotor including:

a rotor shaft part extending in an axial direction;

a plurality of blades secured to an outer periphery of the rotor shaft part;

for each of the blades:

a seal plate facing a blade root of one of the blades on at least one side in the axial direction of the blade root, the seal plate being configured to be fitted into a groove and to seal off a flow of gas in the axial direction, the groove being defined in a platform of the one of the blades so as to be recessed toward an outer side in a radial direction and to extend in a peripheral direction;

a locking plate on an inner side in the radial direction of the seal plate, the locking plate being engaged with an end portion on the inner side in the radial direction of the seal plate with both the locking plate and the end portion on the inner side in the radial direction of the seal plate partially overlapping each other in the radial direction; and a protrusion portion that projects toward the outer side in the radial direction on an end portion on the outer side in the radial direction of the seal plate, the method comprising:

forming a blind hole in advance that allows a removing tool to be inserted therein in a first surface of the seal plate opposite a second surface of the seal plate that faces the blade root;

removing the locking plate; and removing the seal plate by inserting the removing tool into the blind hole and operating the removing tool to move the seal plate to the inner side in the radial direction and in the peripheral direction of the turbine rotor or at least to the inner side in the radial direction, wherein the removing the seal plate is performed by applying a force toward the inner side in the radial direction to the removing tool, wherein an inside groove which extends in the peripheral direction is defined in the rotor shaft part so that an end portion of the inner side in the radial direction of the locking plate is inserted into the inside groove, and wherein the removing the locking plate is performed by moving the locking plate in the peripheral direction while moving the locking plate in the axial direction.

2. The method according to claim 1, wherein:

the turbine rotor further includes a receiving plate including a female screw hole that penetrates in the axial direction and is configured to permit screwing of a push screw, the receiving plate being configured to press the locking plate toward the seal plate in the axial direction, and the method further comprises:

removing the push screw from the receiving plate by turning the push screw screwed into the receiving plate.

3. The method according to claim 2, wherein:

the inside groove which extends in the peripheral direction is defined in the rotor shaft part so that the end portion of the inner side in the radial direction of the locking plate and an end portion of the inner side in the radial direction of the receiving plate are inserted into the inside groove, and a screw operation opening which penetrates in the axial direction is made by cutting out a barrier, which defines a surface of the inside groove, from the outer side in the radial direction toward the inner side in the radial direction.

4. The method according to claim 3, wherein the screw operation opening is defined in the same position as a blade root groove of the blade root in the peripheral direction.

5. The method for removing a seal plate of a turbine rotor according to claim 1, wherein the seal plate is affixed to the groove.

6. The method according to claim 1, wherein the removing the seal plate is performed by inserting the removing tool into the blind hole of the seal plate while applying a force in a direction toward the blade root to the removing tool such that the removing tool does not pierce through the seal plate.

7. The method according to claim 1, wherein:

the turbine rotor further comprises a receiving plate configured to press the locking plate toward the seal plate in the axial direction, the inside groove is defined in the rotor shaft part so that the end portion of the inner side in the radial direction of the locking plate and an end portion of the inner side in the radial direction of the receiving plate are inserted into the inside groove, and the method further comprises removing the receiving plate from the inside groove by moving the receiving plate toward the outer side in the radial direction before the removing the locking plate.

8. The method according to claim 7, wherein:

a female screw hole that penetrates in the axial direction and is configured to permit screwing of a push screw is defined in the receiving plate, and the method further comprises:

removing the push screw from the receiving plate by turning the push screw screwed into the receiving plate is performed before the removing the receiving plate from the inside groove.

* * * * *